US010873139B2

(12) United States Patent
Boudreau

(10) Patent No.: US 10,873,139 B2
(45) Date of Patent: Dec. 22, 2020

(54) BOLTED CONTROLLED GRIPS

(71) Applicant: Hubbell Incorporated, Shelton, CT (US)

(72) Inventor: David Boudreau, Manchester, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/422,173

(22) Filed: May 24, 2019

(65) Prior Publication Data

US 2019/0363461 A1 Nov. 28, 2019

Related U.S. Application Data

(60) Provisional application No. 62/676,562, filed on May 25, 2018.

(51) Int. Cl.

| | |
|---|---|
| ***H01R 4/30*** | (2006.01) |
| ***H01R 11/07*** | (2006.01) |
| ***H01R 4/62*** | (2006.01) |
| ***H01R 4/10*** | (2006.01) |

(52) U.S. Cl.

CPC ..... *H01R 4/30* (2013.01); *H01R 4/10* (2013.01); *H01R 4/62* (2013.01); *H01R 11/07* (2013.01)

(58) Field of Classification Search

CPC ... H01R 4/30; H01R 4/10; H01R 4/62; H01R 11/07; H01R 4/42; H01R 4/44; H01R 4/5083; H01R 4/305; H01R 9/0512; H01R 9/031; H02G 15/113; F16B 2/06; B21D 39/04; F16G 11/06

USPC ..... 439/801

See application file for complete search history.

(56) References Cited

U.S. PATENT DOCUMENTS

| | | | | |
|---|---|---|---|---|
| 4,169,652 A | | 10/1979 | Hockele et al. | |
| 4,708,418 A | * | 11/1987 | Reyna | H01R 9/031 439/785 |
| 5,122,068 A | * | 6/1992 | Koss | H01R 9/0512 439/785 |
| 5,342,224 A | * | 8/1994 | Lefavour | H01R 4/44 439/781 |
| 6,325,678 B1 | * | 12/2001 | Auclair | H01R 4/305 439/803 |

(Continued)

OTHER PUBLICATIONS

PCT/US2019/033943 International Search Report and Written Opinion dated Aug. 27, 2019 (14 pages).

*Primary Examiner* — Jean F Duverne

(74) *Attorney, Agent, or Firm* — Michael Best & Friedrich, LLP

(57) ABSTRACT

An electrical connector configured to control a compression force applied to a core is disclosed. The electrical connector includes a body having a tubular shape, a centerline extending along a longitudinal direction of the body, and an opening extending along the centerline from an outer surface of the body to the center cavity. The body includes a center cavity configured to receive and encase the core. The centerline defines a first portion and a second portion such that the first portion includes a bore hole configured to receive a bolt and the second portion includes a tap hole with a tapered threaded portion configured to receive a screw portion of the bolt. The tap hole is aligned with the bore hole so that the bolt may connect the bore hole and the tap hole to close the opening.

20 Claims, 10 Drawing Sheets

(56) References Cited

U.S. PATENT DOCUMENTS

| | | | | |
|---|---|---|---|---|
| 6,722,929 | B2 * | 4/2004 | Vincent | F16G 11/06 439/787 |
| 7,618,417 | B2 * | 11/2009 | Thomke | A61B 17/6466 403/329 |
| 8,336,362 | B2 * | 12/2012 | Frenken | B21D 39/04 72/416 |
| 9,375,609 | B2 * | 6/2016 | Keller | F16B 2/06 |
| 2007/0205016 | A1 * | 9/2007 | Bryant | H01R 4/5083 174/88 R |
| 2016/0141857 | A1 * | 5/2016 | Palmer | H02G 15/113 174/92 |

* cited by examiner

BOLTED CONTROLLED GRIPS

RELATED APPLICATIONS

This application claims priority to U.S. Provisional Patent Application No. 62/676,562, filed on May 25, 2018, the entire contents of which are incorporated herein by reference.

FIELD

Embodiments relate to an electrical connector configuration adapted to accurately control a compression force applied to composite cores or other cores used in transmission of power.

SUMMARY

Aluminum Conductor Composite Core, (ACCC), is a type of high-temperature, low-sag overhead power line conductor used in the transmission of power. ACCC cables incorporate a light-weight advanced composite core, which replaces the steel wire core of traditional energy cables. Aluminum conductor wires are wrapped around the light-weight composite core in a manner similar to traditional energy cables. The composite core's lighter weight, smaller size, and enhanced strength and other performance advantages over a traditional steel core allows an ACCC cable to double the current carrying capacity over existing transmission and distribution cables and virtually eliminate high-temperature sag.

During the assembly process, the composite core may be inserted into an electrical connector and radially compressed via bolting with bolts or via crimping with a compression die to produce a mechanical connection between the electrical connector and the ACCC cable. This requires that the composite core be able to withstand a certain level of compression force from the electrical connector during the bolting/crimping process. However, although the composite core provides an excellent tensile strength (for example, approximately twenty-one tons), the core may only withstand a small compression force since its compression strength is much lower than its tensile strength. At any point along the length of the core, a compression force exceeding the maximum compression strength tolerable by the core may cause damage to the core and decrease its overall transmission efficiency. Thus, accurate control of the amount of compression force applied by the electrical connector along the length of the core is required to avoid inconsistent or excessive compression at any point along the core.

Examples of electrical connector configurations for forming the mechanical connection between the electrical connector and the ACCC cable are shown in U.S. Pat. Nos. 4,985,003, 5,704,816, 8,025,521, and 9,551,437. These electrical connectors recite a single nut-and-bolt configuration to compress two jaw members together, thereby compressing an inserted core and forming a connection. While these configurations have generally been suitable for their intended purposes, accurate control of the amount of compression delivered to various locations along the length of an inserted core is lacking in the disclosed single nut-and-bolt configuration.

Accordingly, a need exists to provide an electrical connector configuration that can accurately control the compression force applied along the length of the core to avoid compression damage. Specifically, the compression force delivered from the electrical connector to the core may be controlled and/or adjusted at various locations via the tightness of a bolt used to secure an opening of the electrical connector body.

One embodiment discloses an electrical connector configured to control a compression force applied to a core. The electrical connector includes a body having a tubular shape, a centerline extending along a longitudinal direction of the body, and an opening extending along the centerline from an outer surface of the body to the center cavity. The body includes a center cavity configured to receive and encase the core. The centerline defines a first portion and a second portion such that the first portion includes a bore hole configured to receive a bolt and the second portion includes a tap hole with a tapered threaded portion configured to receive a screw portion of the bolt. The tap hole is aligned with the bore hole so that the bolt may connect the bore hole and the tap hole to close the opening.

Another embodiment discloses a method of bolting an electrical connector to control a compression force applied to a core. The method includes defining a centerline extending along a longitudinal direction of a body, boring a bore hole to below the centerline, tapping a tapered tap hole to align with the bore hole, cutting an opening extending along the centerline from an outer surface of the body to a center cavity, and bolting the bore hole to the tap hole via a bolt to close the opening. The centerline identifies a first portion and a second portion such that the bore hole is positioned in the first portion and the tap hole is positioned in the second portion. The center cavity is configured to receive the core.

Other aspects of the application will become apparent by consideration of the detailed description and accompanying drawings.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
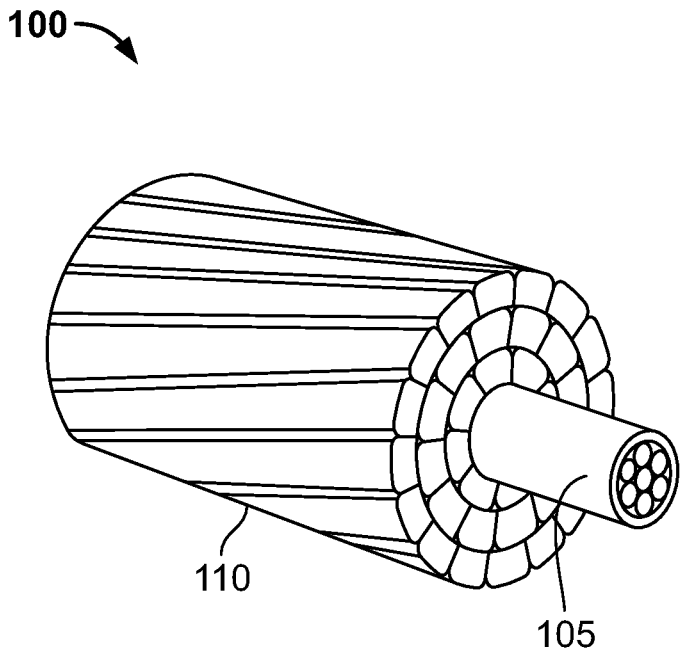
FIG. 1 is a perspective view of an end of an Aluminum Conductor Composite Core (ACCC) cable according to some embodiments.

Before any embodiments of the application are explained in detail, it is to be understood that the application is not limited to the details of construction and the arrangement of components set forth in the following description or illustrated in the following drawings. The application is capable of other embodiments and of being practiced or of being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Also, the functionality described herein as being performed by one component may be performed by multiple components in a distributed manner. Likewise, functionality performed by multiple components may be consolidated and performed by a single component. Similarly, a component described as performing particular functionality may also perform additional functionality not described herein. For example, a device or structure that is "configured" in a certain way is configured in at least that way but may also be configured in ways that are not listed.

As described herein, terms such as "front," "rear," "side," "top," "bottom," "above," "below," "upwardly," and "downwardly" are intended to facilitate the description of the electrical receptacle of the application, and are not intended to limit the structure of the application to any particular position or orientation.

Exemplary embodiments of devices consistent with the present application include one or more of the novel mechanical and/or electrical features described in detail below. Such features may include a body having a tubular shape and including a center cavity configured to receive and encase a core, a centerline extending along a longitudinal direction of the body, and an opening extending along the centerline from an outer surface of the body to the center cavity. In exemplary embodiments of the present application, various configurations of the tubular body and the opening will be described. Furthermore, various placements of at least one bore hole and at least one tap hole in the body of the electrical connector will be detailed. The novel mechanical and/or electrical features detailed herein accurately control the compression force applied by the electrical connector on a composite core used in transmission such that inconsistent compression and/or excessive compression damage along a length of the core may be avoided. Although the application will be described with reference to the exemplary embodiments shown in the figures, it should be understood that the application can be embodied in many alternate forms of embodiments. In addition, any suitable size, shape, or type of elements or materials could be used.

Figure 2:
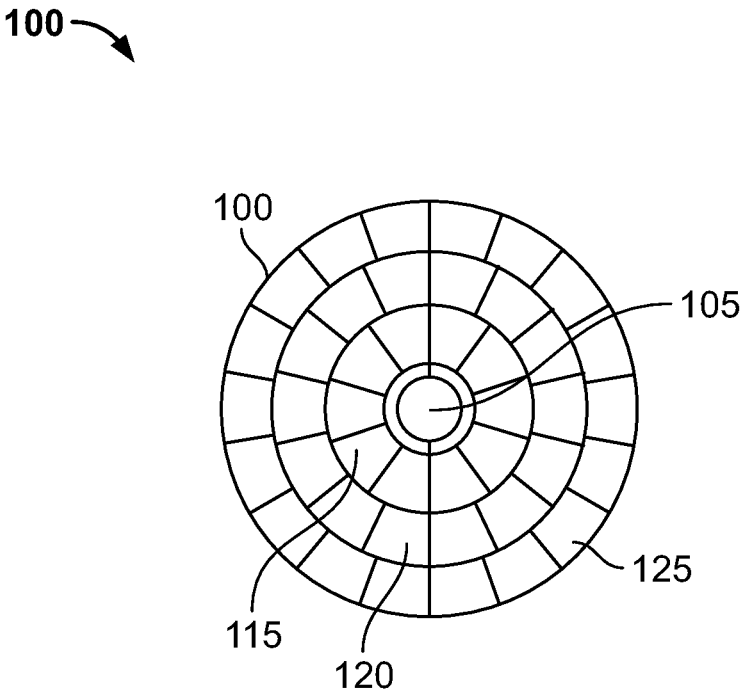
FIG. 2 is a cross sectional view of the ACCC cable shown in FIG. 1 according to some embodiments.

Referring to FIG. 1, there is shown a perspective view of an end of an Aluminum Conductor Composite Core (ACCC) cable 100. The ACCC cable incorporates a light-weight advanced composite core 105 surrounded by conductor wires 110. The composite core 105 may be composed of carbon composite, glass fiber, or other materials suitable for conduction of transmitted power. The conductor wires 110 are generally made of aluminum, although other materials may be used to achieve similar results. Referring to FIG. 2, the wires 110 include inner strands 115, surrounded by middle strands 120, surrounded by outer strands 125. In other embodiments, various layers of strands may wind around the composite core 105 to produce different transmission parameters. The ACCC cable 100 is lighter and has a greater current carrying capacity compared to traditional cables with steel cores. The use of ACCC cable 100 allows the current carrying capacity to double over existing transmission and distribution cables while virtually eliminating high-temperature sag, thus increasing system reliability.

Figure 3:
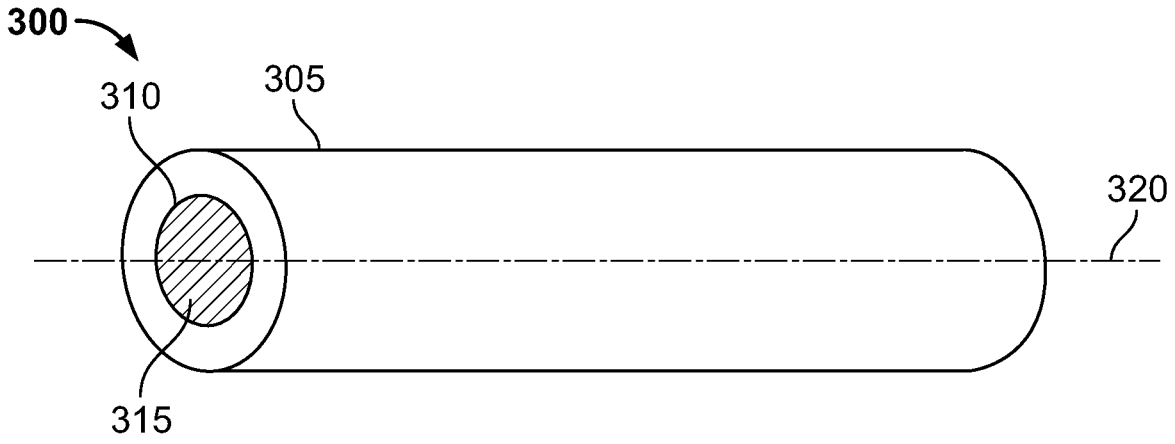
FIG. 3 is perspective view of an electrical connector tube body according to some embodiments.

Referring to FIG. 3, an electrical connector body 300 having a tubular shape is shown according to one embodiment. The body 300 has an outer surface 305 and an inner surface 310 that defines a center cavity 315 configured to receive and encase the core 105 (FIG. 1). A centerline 320 extends along a longitudinal direction of the body 300 and serves as a reference line. The circumference of the inner surface 310 is configured to be smaller than the circumference of the inserted core 105 by a compression factor such that when the electrical connector body 300 fully encases the inserted core 105, a radial compression force is applied by the inner surface 310 on the inserted core 105. This applied radial compression force must be more than the minimum strength required to form the necessary mechanical connection between the electrical connector body 300 and the core 105, but less than the maximum tolerable compression strength of the core 105 at all points along its length. Insufficient compression strength will result in the core 105 disengaging from the electrical connector body 300 and disrupting power transmission while excessive or inconsistent compression strength will damage the core 105 and decrease its transmission efficiency. Thus, there is a need for accurate control and application of the compression force to the length of the core 105, as described in further detail below.

Figure 4:
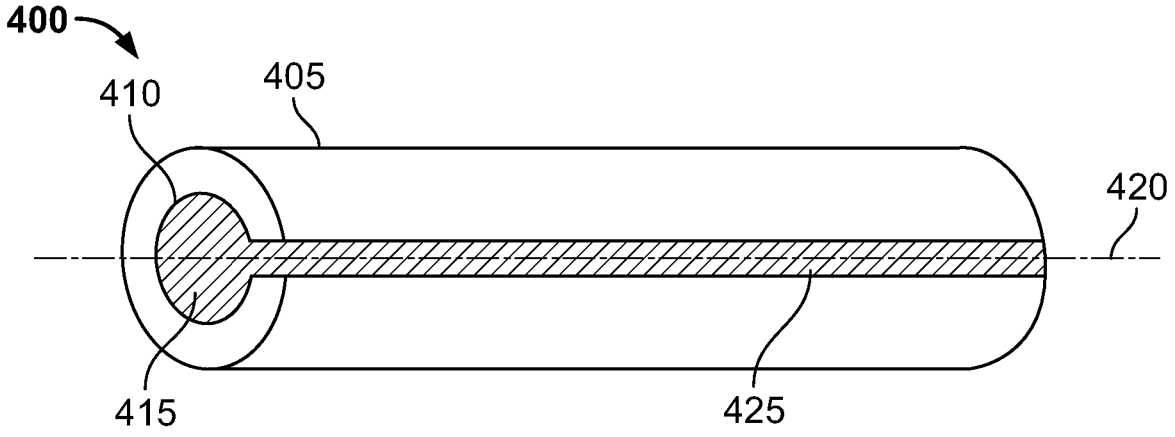
FIG. 4 is a perspective view of a C-Shaped electrical connector tube body according to some embodiments.
Figure 5:
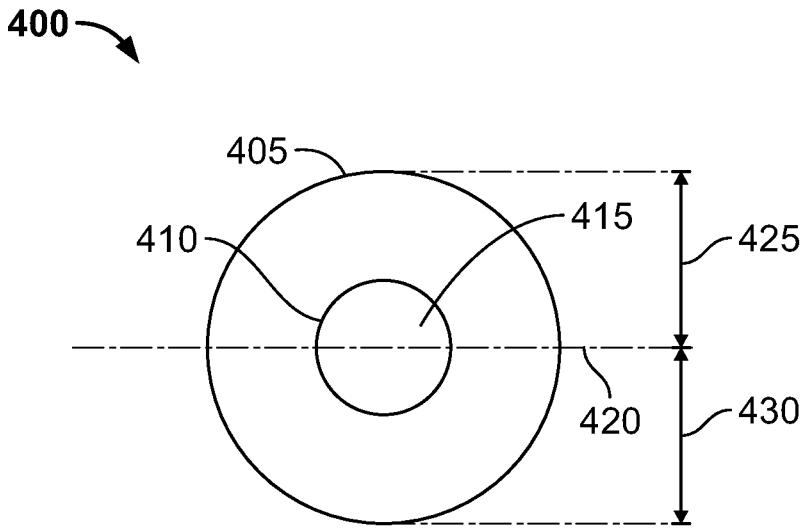
FIGS. 5-8 are cross-sectional end views of the C-Shaped electrical connector at various stages of the bolting process.
Figure 6:
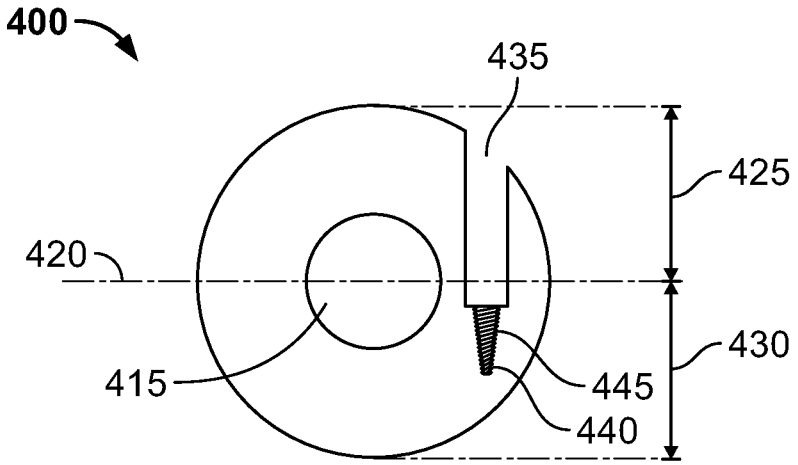
Figure 7:
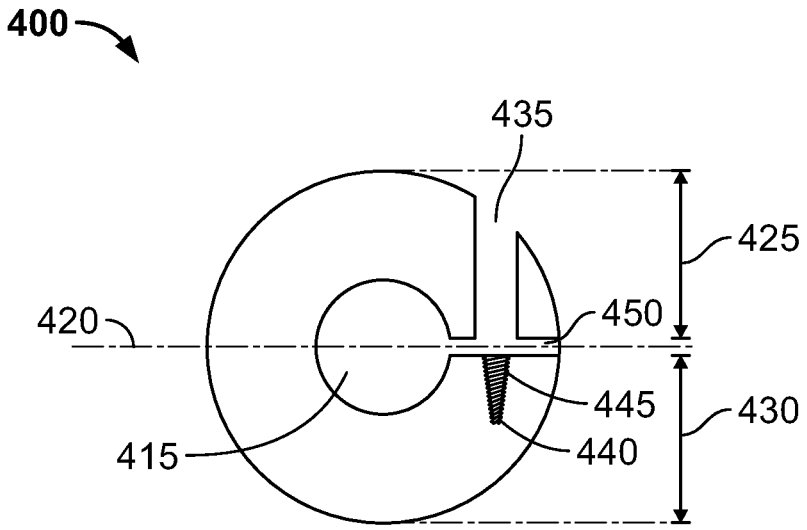
Figure 8:
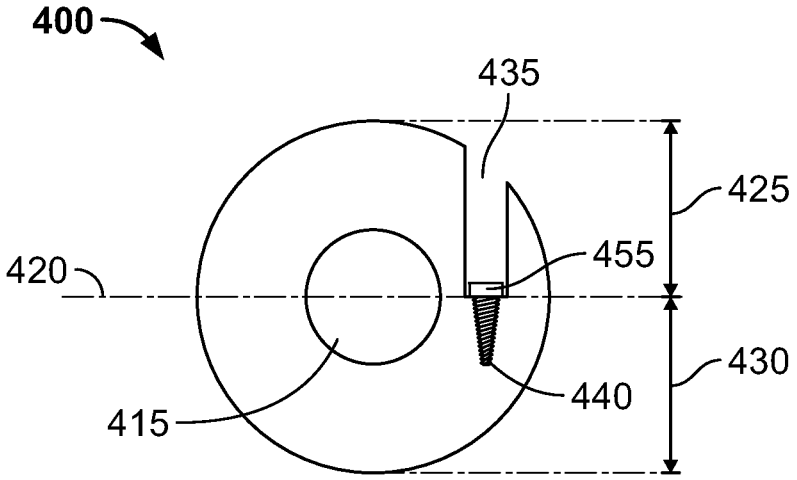

Referring to FIG. 4, a C-shaped electrical connector body 400 according to one embodiment includes an outer surface 405 and an inner surface 410 that defines a center cavity 415 configured to receive and encase the core 105 (FIG. 1). A reference centerline 420 extends along a longitudinal direction of the C-shaped electrical connector body 400. An opening 425 extends along the centerline 420 from the outer surface 405 to the center cavity 415. The opening 425 allows a larger diameter of the inner surface 410 such that the corresponding circumference of the inner surface 410 is larger than the circumference of the core 105. This allows easy insertion of the core 105 into the center cavity 415. After inserting the core 105 into the center cavity 415, the opening 425 may be closed (for example, via one or more bolts) in order to form the mechanical connection between the body 400 and the inserted core 105 necessary for power transmission.

Referring to FIGS. 5-8, a bolting process for the C-shaped electrical connector body 400 according to some embodiments is shown. During the bolting process, a reference centerline 420 extending along a longitudinal direction of the body 400 is provided to symmetrically divide the body 400 into a first portion 425 and a second portion 430. The placement of the centerline 420 may vary in other embodiments not detailed herein, and the proportional size of the first portion 425 in relation to the second portion 430 may vary to achieve the same results and thus do not deviate from the teachings of the present application. A bore hole 435 is counterbored in the first portion 425 from the outer surface 405 to below the centerline 420. A tapered tap hole 440 including a threaded portion 445 is tapped in the second portion 430 to align with the bore hole 435. An opening 450 is cut along the centerline 420 from the outer surface 405 to the center cavity 415 such that the electrical connector body 400 forms a C-shape. The bore hole 435 and the aligning tap hole 440 should be aligned with the opening 450 such that there is essentially no interference of the bore hole 435 and the tap hole 440 with the center cavity 415.

Figure 9:
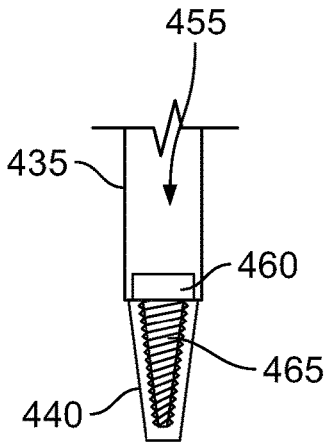
FIG. 9 is an enlarged view of an engaged bolt according to some embodiments.

When the core 105 (FIG. 1) is successfully inserted, a bolt 455 (see FIG. 8) may be used to connect the bore hole 435 and the tap hole 440 to close the opening 450. Referring to FIG. 9, in some embodiments the bolt 455 includes a bolt head 460 and a bolt screw 465. When the bolt 455 successfully closes the opening 450, the bolt head 460 is inserted into the bore hole 435 and the bolt screw 465 is configured to engage with the threaded portion 445 (not labeled) of the tapered tap hole 440. Closing the opening 450 causes a decrease in the diameter and corresponding circumference of the inner surface 410 such that a compression factor tolerable by the core 105 (FIG. 1) is applied by the inner surface 410 on the inserted core 105. A number of bolts 455 may be positioned to close the opening 450 along the length of the body 400 in certain embodiments, the variations in the number of bolts used are not exhaustively described herein. By varying the tightness of each bolt 455, an accurately controlled compression force may be applied to various locations along the length of the core 105, thus forming a sufficient mechanical connection between the body 400 and the core 105 while avoiding excessive compression damage to the core 105.

Figure 10:
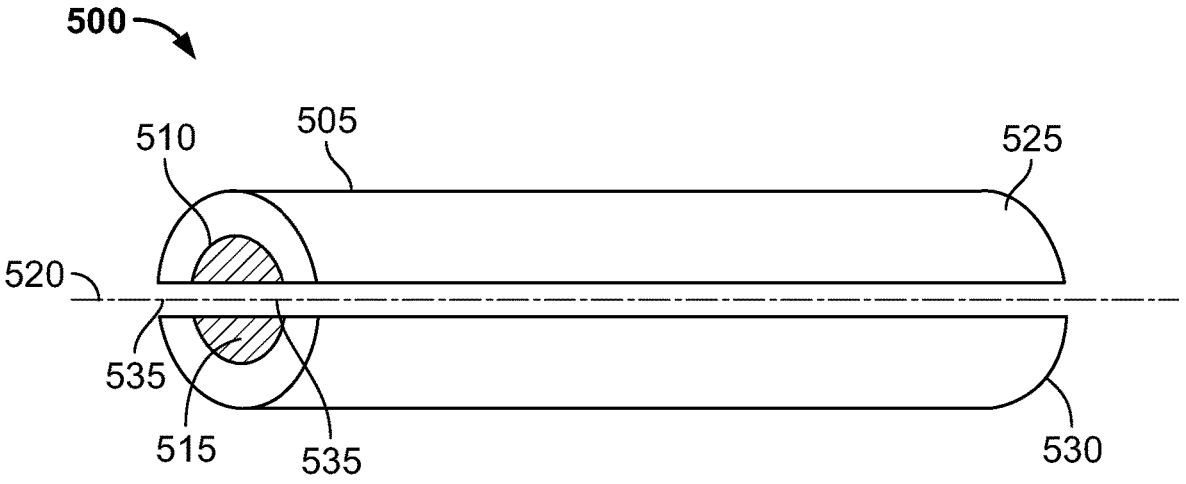
FIG. 10 is a perspective view of a Split-in-Half electrical connector tube body according to some embodiments.
Figure 11:
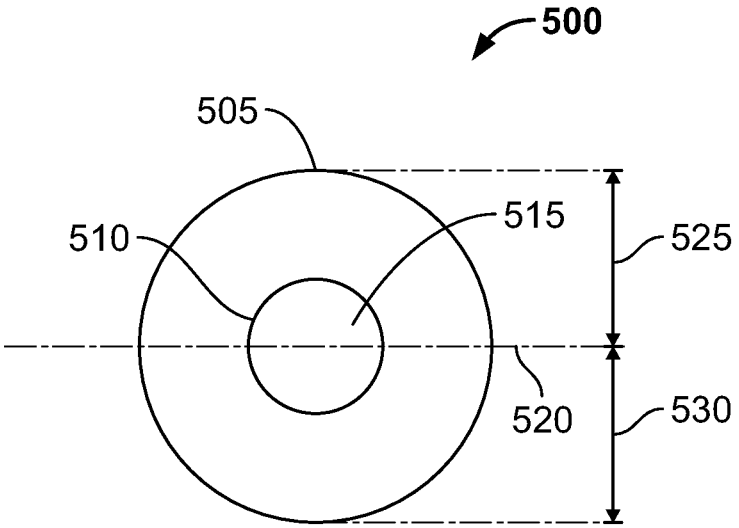
FIGS. 11-14 are cross-sectional end views of the Split-in-Half electrical connector at various stages of the bolting process.
Figure 12:
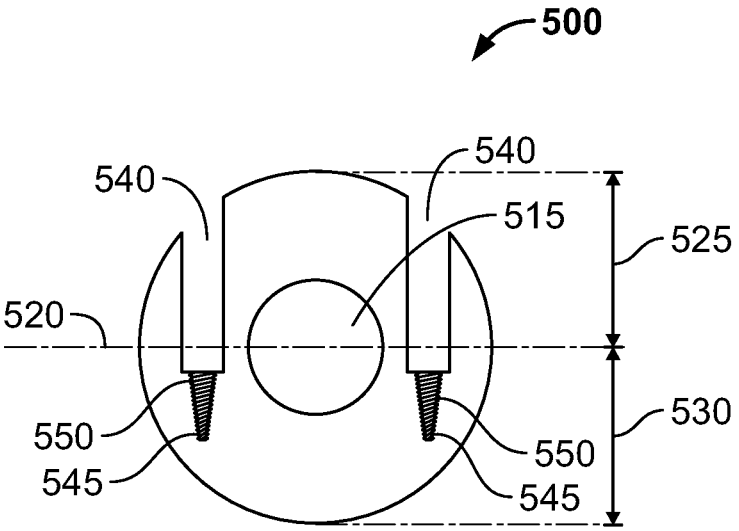
Figure 13:
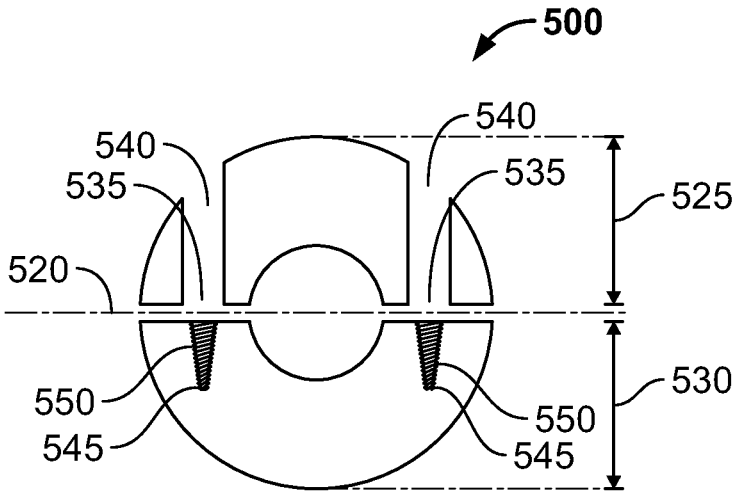
Figure 14:
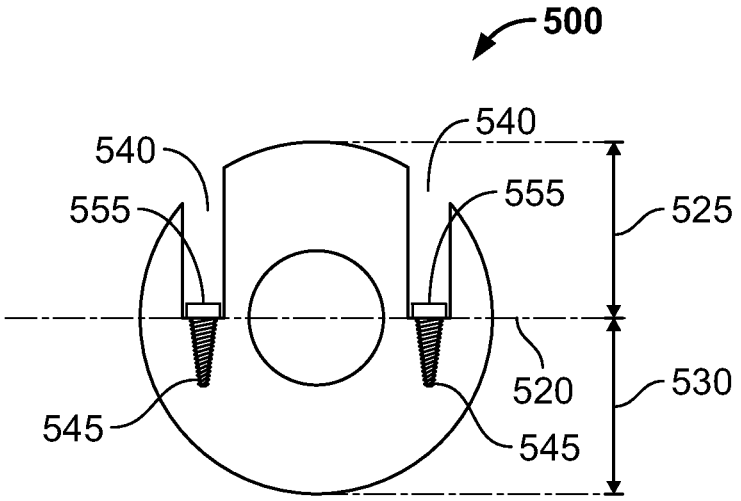

Referring to FIG. 10, a Split-in-Half electrical connector body 500 according to another embodiment includes an outer surface 505 and an inner surface 510 that defines a center cavity 515 configured to receive and encase the core 105 (FIG. 1). A reference centerline 520 extends along a longitudinal direction of the Split-in-Half electrical connector body 500. Two openings 535 directly opposite each other on either side of the body 500 each extend along the centerline 520 from the outer surface 505 to the center cavity 515, thereby completely disconnecting the body 500 into a first portion 525 and a second portion 530. The placement of the centerline 520 may vary in other embodiments not detailed herein, and the proportional size of the first portion 525 in relation to the second portion 530 may vary to achieve the same results and thus do not deviate from the teachings of the present application. Once the core 105 is inserted into the center cavity 515, the two openings 535 may be bolted close with at least one bolt for each opening 535 to form the mechanical connection between the body 500 and the inserted core 105 (not shown) necessary for power transmission.

FIGS. 11-14 show a bolting process for the Split-in-Half electrical connector body 500. Similar to the bolting process for the C-shaped electrical connector body 400 shown in FIGS. 5-8, a reference centerline 520 extending along a longitudinal direction of the body 500 divides the body 500 into a first portion 525 and a second portion 530. Two bore holes 540 are counterbored in the first portion 525 from the outer surface 505 to below the centerline 520. Likewise, two tapered tap holes 545, each including a threaded portion 550, are tapped in the second portion 530 to align with the two bore holes 540. Two openings 535 positioned directly opposite each other on either side of the body 500 are cut along the centerline 520 such that each opening 535 extends from the outer surface 505 to the center cavity 515. This completely disconnects the body 500 to form a Split-in-Half configuration. The bore holes 540 and the aligning tap holes 545 should be positioned to align with the each opening 535 such that there is essentially no interference of the bore holes 540 and the tap holes 545 with the center cavity 515.

Figure 15:
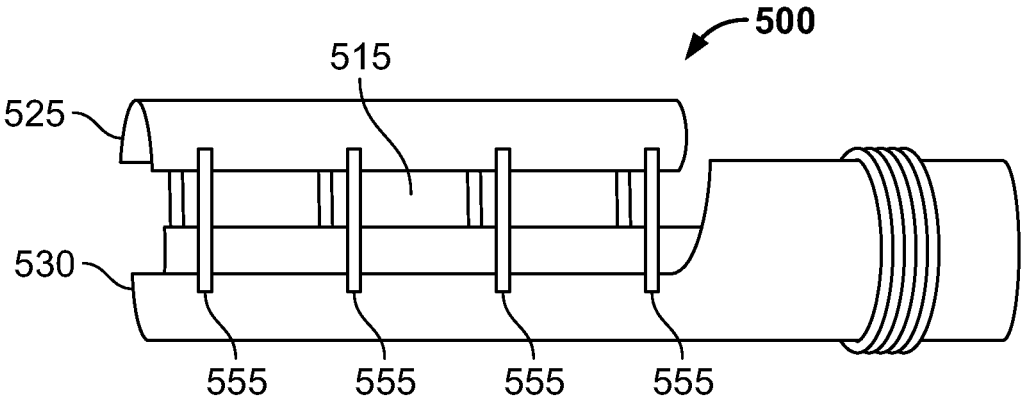
FIG. 15 is an exploded view of multiple bolt locations in a Split-in-Half electrical connector according some embodiments.

When the core 105 (FIG. 1) is successfully inserted, a bolt 555 (see FIG. 14) may be used to connect each bore hole 540 to its corresponding the tap hole 545 and close the corresponding opening 535. A number of bolts 555 may be positioned to close the openings 535 along the length of the body 500, as shown in FIG. 15. The specific number of bolts 555 used may vary in different embodiments and not exhaustively described herein. By varying the tightness of each bolt 555, an accurately controlled compression force may be applied to various locations along the length of the core 105, thus forming a sufficient mechanical connection between the body 500 and the core 105 while avoiding excessive compression damage to the core 105.

Figure 16A:
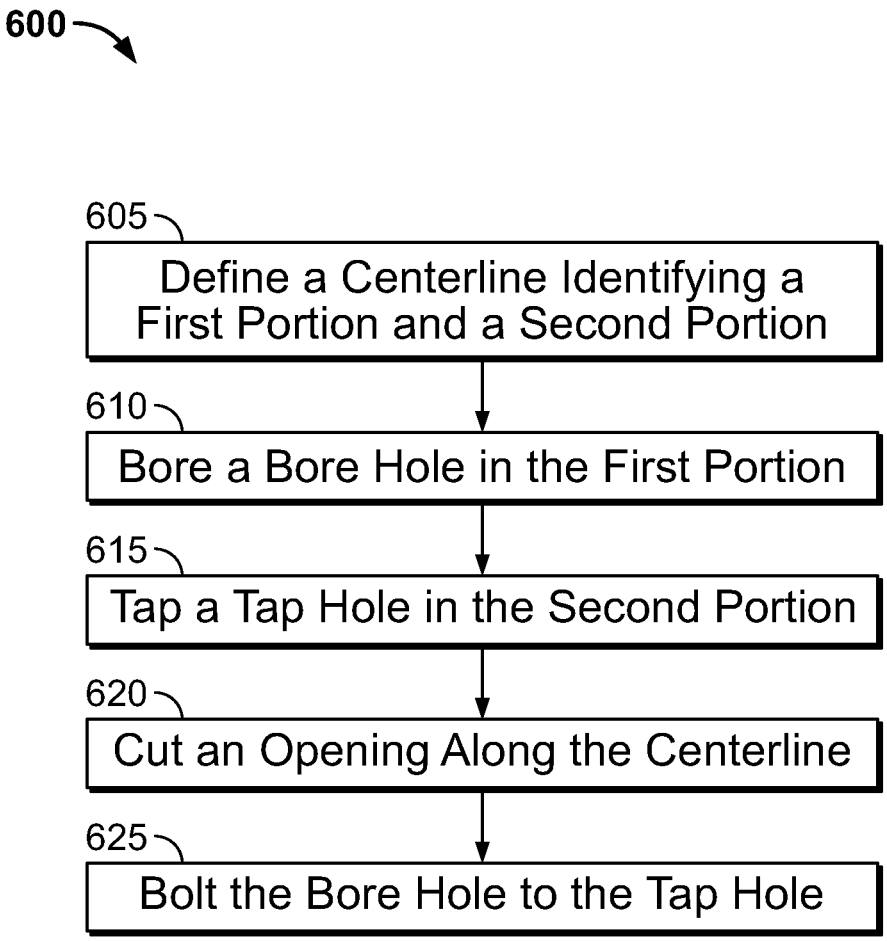
FIG. 16A is a flowchart illustrating a process of bolting an electrical connector according to some embodiments.

FIG. 16A is a flowchart for a process, or operation, 600 of bolting an electrical connector to control a compression force applied to a core, according to some embodiments. It should be understood that the order of the steps disclosed in process 600 could vary. Furthermore, additional steps may be added and not all of the steps may be required. In some embodiments, process 600 is performed by an electronic processor of an automatic compression die or a central processing unit (CPU) of an electrical connector manufacturing machine. In other embodiments, the process 600 may be performed by a user or operator.

As shown in FIG. 16A, the electrical connector body 300 (FIG. 3) is first defined by a centerline 320 (block 605). The centerline may extend along the longitudinal direction of the body 300 and define a first portion 425/525 and a second portion 430/530. At least one bore hole 435/540 is counterbored into the first portion 425/525 to below the centerline 320 (block 610) and at least one tapered tap hole 440/545 is tapped into the second portion 430/530 to align with the bore hole 435/540 (block 615). In some embodiments, the bore hole 435/540 is configured to receive the bolt head 460 while the tap hole 440/545 includes a tapered threaded portion 445/550 configured to engage with the bolt screw 465. The bore hole 435/540 may be positioned as to not interfere with the central cavity 315 of the electrical connector body 300. An opening 450/535 is cut to extend along the centerline 320 from the outer surface 305 to the center cavity 315 of the body 300 (block 620). After inserting the composite core 105 (FIG. 1), the bolt 455/555 is used to bolt the bore hole 435/540 to the aligning tap hole 440/545 (block 625). The bolting process 600 may be completed such that there is no interference of the bolt 455/555 with the inserted core 105. The tightness of the bolt 455/555 may be altered for each bore-tap hole pair to accurately control the compression force applied to cores 105.

Figure 16B:
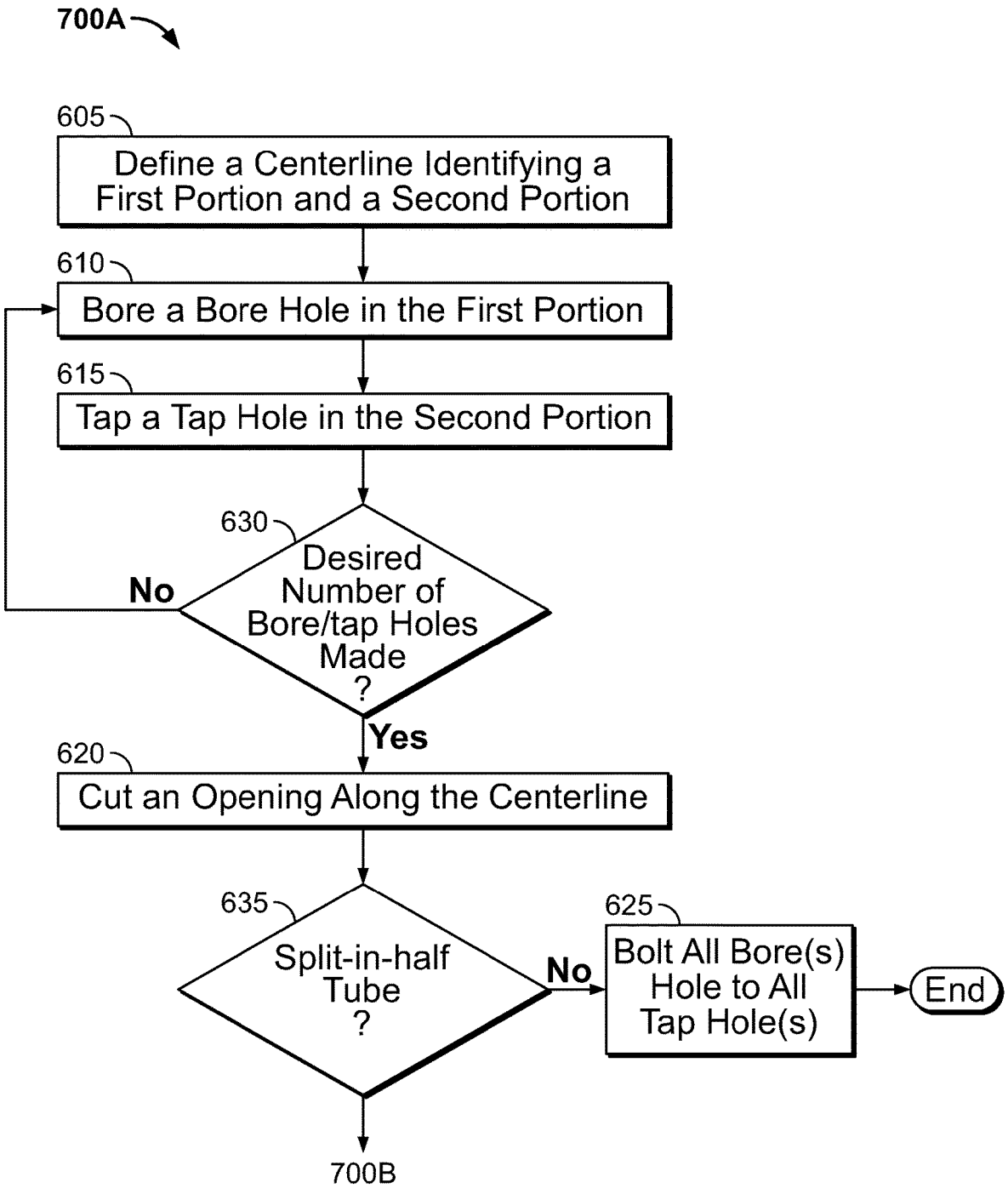
FIGS. 16B-C is a flowchart illustrating a process of bolting multiple bolt locations according to some embodiments.
Figure 16C:
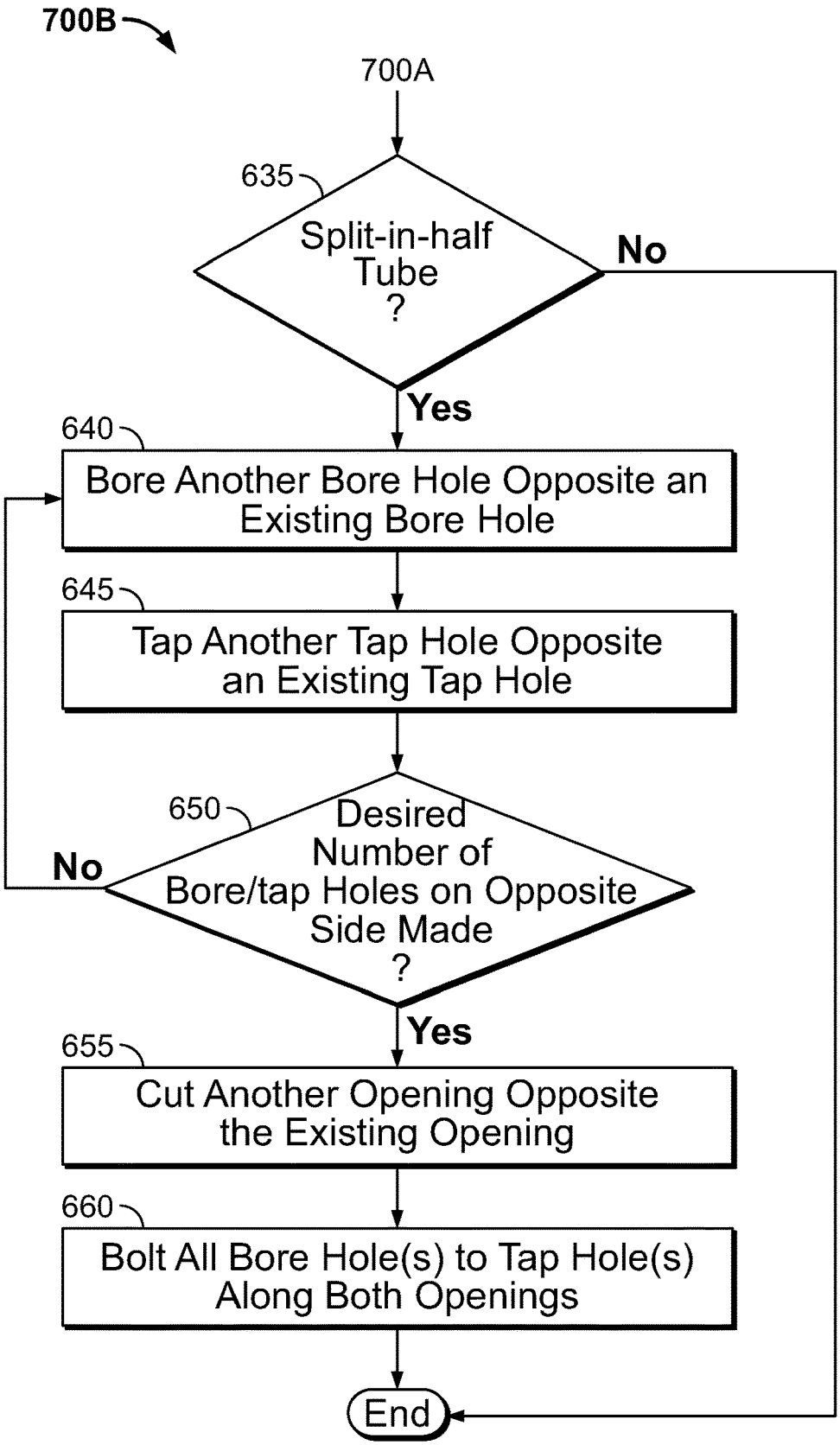

In many cases, multiple bolt locations may be desirable. FIGS. 16B-C illustrate a process 700A-B of bolting multiple bolt locations along the length of the electrical connector body 300. Blocks in common with FIG. 16A are identified with like reference numerals. After blocks 605-615 of FIG. 16B have been executed, the process 700A determines whether the desired number of bore holes 435 and tap holes 440 have been made along the length of the electrical connector body 300 (block 630). If not, the boring and tapping processes in blocks 610-615 are repeated. If yes, the process 700A proceeds to cut the first opening 450 to create a C-shaped electrical connector 400 (block 620). At this point, the process 700A determines whether a Split-in-Half electrical connector 500 is desired (block 635). If no, the process 700A inserts the core 105, bolts the bore hole(s) 435 to the tap holes 440 (block 625), and the entire process 700A-B terminates. Otherwise, the process 700A proceeds to process 700B.

During process 700B as shown in FIG. 16C, another bore hole 540 is counterbored in the first portion 525 to below the centerline 320 opposite the existing bore hole 435 (block 640). Likewise, another tap hole 545 is tapped in the second portion 530 to align to the another bore hole 540 (block 645). The process 700B determines whether the desired number of bore holes 540 and tap holes 545 have been made along the length of the Split-in-Half electrical connector 500 (block 650). If not, blocks 640-645 are repeated. If yes, the process 700B proceeds to cut a second opening 535 to create the Split-in-Half electrical connector 500 (block 655). After the Split-in-half electrical connector 500 is created, the process 700B inserts the core 106 and bolts all the bore holes 540 and tap holes 545 along the two openings 535 (block 660), thereby completing the process 700A-B. Both the bolted C-shaped electrical connector 400 and the bolted Split-in-Half electrical connector 500 may be capable of accurately controlling the compression force applied to various points along the length of the inserted composite core 105, thereby ensuring sufficient connection while avoiding compression damage.

All combinations of embodiments and variations of design are not exhaustively described in detail herein. Said combinations and variations are understood by those skilled in the art as not deviating from the teachings of the present application.

What is claimed is:

1. An electrical connector assembly configured to control a compression force applied to a core, the electrical connector assembly comprising the core including at least one selected from a group consisting of a carbon composite and a glass fiber, and an electrical connector including:

a body having a tubular shape and including a center cavity configured to receive and encase the core;

a centerline extending along a longitudinal direction of the body, the centerline defining a first portion and a second portion; and an opening extending along the centerline from an outer surface of the body to the center cavity, wherein the first portion includes a bore hole configured to receive a bolt, wherein the second portion includes a tap hole with a tapered threaded portion configured to receive a screw portion of the bolt, wherein the tap hole is aligned with the bore hole, and wherein the bolt connects the bore hole and the tap hole to close the opening.

2. The electrical connector assembly according to claim 1, wherein the bore hole and the tap hole are aligned with the opening such that there is no interference of the bore hole and the tap hole with the center cavity.

3. The electrical connector assembly according to claim 1, wherein the first portion further includes a plurality of bore holes and the second portion further includes a plurality of tap holes, the plurality of bore holes and the plurality of tap holes being positioned at multiple locations along the opening such that there is no interference of the plurality of bore holes and the plurality of tap holes with the center cavity.

4. The electrical connector assembly according to claim 3, wherein each of the plurality of tap holes is aligned to a corresponding bore hole.

5. The electrical connector assembly according to claim 1, further comprising another opening extending along the centerline from the outer surface of the body to the center cavity, the another opening being positioned directly opposite the opening such that the first portion fully disengages from the second portion.

6. The electrical connector assembly according to claim 5, further comprising another bore hole and another tap hole aligned with the another opening such that there is no interference of the another bore hole and the another tap hole with the center cavity.

7. The electrical connector assembly according to claim 6, wherein the first portion further includes a plurality of another bore holes and the second portion further includes a plurality of another tap holes, the plurality of another bore holes and the plurality of another tap holes being positioned at multiple locations along the another opening such that there is no interference of the plurality of another bore holes and the plurality of another tap holes with the center cavity.

8. The electrical connector assembly according to claim 7, wherein each of the plurality of another tap holes is aligned to a corresponding another bore hole.

9. The electrical connector assembly according to claim 1, wherein a circumference of the center cavity is smaller than an outer circumference of the core by a compression factor.

10. The electrical connector assembly according to claim 9, wherein the circumference of the center cavity applies a radial compression force on the outer circumference of the core via the bolt.

11. The electrical connector assembly according to claim 1, wherein the electrical connector is positioned within a conductor wire.

12. The electrical connector assembly according to claim 11, wherein the conductor wire includes three sets of wire strands wound around the core.

13. The electrical connector assembly according to claim 12, wherein the three sets of wire strands wound around the core include aluminum.

14. A method of bolting an electrical connector to control a compression force applied to a core, the method comprising:

defining a centerline extending along a longitudinal direction of a body, the centerline identifying a first portion and a second portion;

boring a bore hole in the first portion to below the centerline;

tapping a tapered tap hole in the second portion to align with the bore hole;

cutting an opening extending along the centerline from an outer surface of the body to a center cavity configured to receive the core;

positioning the core in the center cavity, the core including at least one selected from a group consisting of a carbon composite and a glass fiber; and bolting the bore hole to the tap hole via a bolt to close the opening.

15. The method according to claim 14, wherein boring the bore hole includes positioning the bore hole to align with the opening such that there is no interference of the bore hole with the central cavity.

16. The method according to claim 14, further comprising:

boring another bore hole in the first portion to below the centerline;

tapping another tap hole in the second portion to align with the another bore hole;

cutting another opening extending along the centerline from the outer surface of the body to the center cavity, the another opening being positioned directly opposite the opening such that the first portion fully disengages from the second portion; and bolting the another bore hole to the another tap hole via another bolt to close the another opening, wherein the another bore hole is aligned with the another opening such that there is no interference of the another bore hole with the center cavity.

17. The method according to claim 14, further comprising winding a conductor wire around the body.

18. The electrical connector assembly according to claim 17, wherein the conductor wire includes three sets of wire strands wound around the core.

19. An electrical connector assembly configured to control a compression force applied to a core, the electrical connector assembly comprising an electrical connector including:

a body having a tubular shape and including a center cavity configured to receive and encase the core;

a centerline extending along a longitudinal direction of the body, the centerline defining a first portion and a second portion; and an opening extending along the centerline from an outer surface of the body to the center cavity, wherein the first portion includes a bore hole configured to receive a bolt, wherein the second portion includes a tap hole with a tapered threaded portion configured to receive a screw portion of the bolt, wherein the tap hole is aligned with the bore hole, and wherein the bolt connects the bore hole and the tap hole to close the opening, and a conductor wire wound around the electrical connector.

20. The electrical connector assembly according to claim 19, wherein the electrical connector assembly includes the core, wherein the core includes at least one selected from a group consisting of a carbon composite and a glass fiber.

* * * * *